United States Patent [19]

Yamauchi et al.

[11] Patent Number: 4,525,209

[45] Date of Patent: Jun. 25, 1985

[54] PROCESS FOR PRODUCING LOW P CHROMIUM-CONTAINING STEEL

[75] Inventors: Takashi Yamauchi, Tokuyama; Shigeaki Maruhashi, Kure; Shinkichi Koike; Keizo Yamada, both of Hachinohe, all of Japan

[73] Assignees: Pacific Metals & Co. Ltd.; Nisshin Steel Co. Ltd., both of Japan

[21] Appl. No.: 606,182

[22] Filed: May 2, 1984

[51] Int. Cl.[3] ..... C21C 7/00

[52] U.S. Cl. ..... 75/51.5; 75/51.6; 75/53; 75/59.12

[58] Field of Search ..... 75/51, 52, 59, 60, 53

[56] References Cited

U.S. PATENT DOCUMENTS

| | | | |
|---|---|---|---|
| 4,045,213 | 8/1977 | Leroy | 75/51 |
| 4,329,171 | 5/1982 | Robert | 75/52 |
| 4,365,992 | 12/1982 | Sieckman | 75/60 |
| 4,430,117 | 2/1984 | Spenceley | 75/52 |

*Primary Examiner*—Peter D. Rosenberg

*Attorney, Agent, or Firm*—Kane, Dalsimer, Kane, Sullivan and Kurucz

[57] ABSTRACT

A process for producing a low P chromium-containing steel in an AOD vessel from a high P chromium-containing molten pig iron comprising a first stage of recarborization, desiliconzation and temperature raising, a second stage of dephosphorization with slag, which may be repeated, and a third stage of conventional refining.

5 Claims, No Drawings

PROCESS FOR PRODUCING LOW P CHROMIUM-CONTAINING STEEL

TECHNICAL FIELD OF THE INVENTION

In one aspect the present invention relates to a process for the production of a low P chromium-containing steel, especially a low P stainless steel, using a so-called AOD vessel. By the process according to the invention a chromium-containing molten pig iron used as a starting material can be advantageously dephosphorized even if the starting material contains a relatively high amount of P. In another aspect the invention relates to a method of operating an AOD vessel for the production of a low P chromium-containing steel starting from a high P chromium-containing molten pig iron.

BACKGROUND OF THE INVENTION

It is well known that P (phosphorus) in iron and steel generally acts adversely except for in certain special cases and especially in stainless steel it causes and develops hot cracking and stress corrosion cracking. It is difficult, however, to remove P from a chromium-containing molten pig iron when compared with the cases of ordinary steels, and therefore it has been conventionally practiced in a commercial scale production of chromium-containing steels to prepare a low P chromium-containing pig iron using carefully selected low P starting materials and to subject such a low P chromium-containing molten pig iron to a decarburization treatment, for example, by an AOD process.

The invention has been made for the purpose of developing a novel process for producing a chromium-containing steel wherein even such phosphorus-containing materials that could not be used in the prior art processes may be sucessfully used as starting materials. For this purpose the inventors have extensively studied and tested how to advantageously refine a chromium-containing molten pig iron to a low P molten steel in a commercial scale installation, using dephosphorizing fluxes for use in dephosphorization of chromium-containing molten pig irons, including a flux proposed by the Applicant in Japanese Patent Laid-open Specification No. 56-5910 published on Jan. 22, 1981, which corresponds to U.S. Pat. No. 4,290,803 to S. Maruhashi et al issued on Sep. 22, 1981. As a result, a novel refining process for producing a low P chromium steel from a high P chromium containing molten pig iron has now been established.

SUMMARY OF THE INVENTION

According to the invention a process for producing a low P chromium-containing steel, in a vessel equipped with a lance adapted to top blowing of oxygen and with at least one tuyere of a double tube structure adapted to bottom blowing of oxidizing and non-oxidizing gases alone or in combination, starting from a chromium-containing molten pig iron which contains not more than 4.5% by weight of C, at least 0.010% by weight of P and at least 3.0% by weight of Cr, comprises the steps of:

A. adding a solid carbon source to the chromium-containing molten pig iron in the vessel in an amount sufficient to provide a chromium-containing molten pig iron of a carbon content of at least 4.5% by weight at the end of the step of D below, B. agitating the content in the vessel after or during the step A by bottom blowing thereinto a non-oxidizing gas, C. top and/or bottom blowing oxygen to the molten pig iron in at least the last part of the step B to provide a chromium-containing molten pig iron of a temperature ranging between 1500° C. and 1700° C. containing not more than 0.15% by weight of Si and at least 4.5% by weight of C, D. substantially removing a slag formed in the preceding steps from the vessel, E. adding a dephosphorization flux to the molten pig iron in the vessel, F. agitating the content in the vessel after or during the step E by bottom blowing thereinto a non-oxidizing gas to promote effective contact of the molten pig iron with a slag formed, while maintaining the concentration of iron oxides in the slag at a level of at least 1.0% by weight, G. substantially removing the slag from the vessel, and H. bottom blowing or top and bottom blowing oxygen to the molten pig iron in the vessel for decarburization, while bottom blowing thereinto a non-oxidizing gas.

Preferably at least the last part of the step F is carried out while top blowing oxygen onto the content of the vessel thereby maintaining the concentration of iron oxides in the slag not less than 1.0% by weight.

If the degree of dephosphorization achieved by one cycle of the steps E, F and G is unsatisfactory, the cycle may be repeated until a desired level of P is reached, with an intermediate step, between the successive cycles, of raising the temperature of the molten pig iron to a temperature ranging between about 1500° C. and about 1700° C. by blowing oxygen with or without addition of an oxidizable exothermic material to the molten pig iron, while controlling the carbon content of the molten pig iron not less than 4.5% by weight and the silicon content of the molten pig iron not more than 0.15% by weight.

As the dephosphorizing flux use is advantageously made of a flux disclosed in Japanese Patent Laid-open Specification No. 56-5910, which corresponds to U.S. Pat. No. 4,290,803. This flux comprises 30–80% by weight of at least one compound selected from the fluorides and chlorides of alkaline earth metals, 0.4 to 30% by weight of at least one compound selected from lithium oxide and lithium carbonate, 5–50% by weight of at least one compound selected from iron oxides and nickel oxide, and 0–40% by weight of at least one compound selected from the oxides and carbonates of alkaline earth metals.

DESCRIPTION OF THE INVENTION

The process of the invention is carried out using a refining vessel equipped with a lance adapted to top blowing of oxygen and with at least one tuyere of a double tube structure adapted to bottom blowing of oxidizing and non-oxidizing gases alone or in combination, known as an AOD vessel or a top- and bottom-blowing converter. The tuyere comprises concentric inner and outer tubes designed so that oxygen or a mixture of oxygen and a non-oxidizing gas may be blown through the inner tube, while a cooling gas may be blown through the outer tube for the purpose of an oxygen-blowing operation. It is also possible to use such a tuyere only for an agitation purpose by blowing there-through a non-oxidizing gas, such as argon, nitrogen, gaseous hydrocarbon and steam alone or in combination without blowing oxygen.

The process of the invention includes three stages. The first stage comprises the steps A, B, C and D, while the second stage comprises the steps E, F and G, the third stage comprising the step H. The first stage is to prepare a high C and low Si chromium-containing molten pig iron of a satisfactorily high temperature which can be suitably dephosphorized in the subsequent stage. The second stage, which may be repeated, is to effectively dephosphorize the high C and low Si chromium-containing molten iron to a desirably low P level. The third stage is to decarburize the high C and low Si chromium-containing molten pig iron, which has been dephosphorized in the second stage. The decarburization process carried out in the third stage is known in the art in itself. According to the invention the series of these three stages can be effectively carried out using an AOD vessel.

The first stage is to recarburize and desiliconize a chromium-containing molten pig iron prepared from phosphorus-containing materials, and at the same time to maintain or raise the temperature of the molten pig iron at or to a satisfactorily high temperature. For effective dephosphorization of a chromium-containing molten pig iron with a dephosphorizing flux, the treatment should preferably be carried out with a high C and low Si chromium-containing pig iron, which contains at least 4.5% by weight of C and not more than 0.2% by weight, preferably not more than 0.15% by weight of Si, and the temperature of the molten pig iron must be kept well above a predetermined level. The first stage is to realize these conditions. In a case wherein a high carbon ferro-chromium is used as a main Cr source for the preparation of a chromium-containing molten pig iron, the carbon content of the resulting molten pig iron is normally below the above-mentioned C level, and the silicon content of the same is well above the above-mentioned Si level unless otherwise specially treated. In the first stage of the process, to such a low C high Si chromium-containing molten pig iron in the vessel a solid carbon source (for example, powder or particles of coke) is added in an amount sufficient to provide a chromium-containing molten pig iron of a carbon content of at least 4.5% by weight at the end of the first stage; after or during the addition of the carbon source the content in the vessel is agitated by bottom blowing thereinto a non-oxidizing gas (for example, argon or nitrogen), and oxygen blowing (top and/or bottom) is carried out under bottom blowing of the non-oxidizing gas until the silicon content of the molten pig iron is reduced to a level of not higher than 0.15% by weight. While the carbon source may be added from the top of the vessel, it may also be added from the bottom of the vessel by carrying it with the bottom blown non-oxidizing gas. While the recarburization of the molten pig iron is endothermic, the oxygen blowing causes desiliconization which serves to raise the temperature of the molten pig iron. The lower the temperature, the desiliconization preferentially proceeds to the decarburization, and in consequence the above-mentioned three conditions essential to the slag dephosphorization, that is recarburization, desiliconization and a raised temperature, are achieved in the first stage. The stronger the agitation by means of the bottom blown gas, the better the recarburization proceeds. In a case wherein the initial Si concentration is relatively high and thus a considerable amount of silicon is to be removed, it is necessary to control the basicity of a slag formed. This may be done, for example, by addition of lime. While the first stage is completed by removing the slag formed from the vessel, an additional step for raising the temperature primarily due to oxidation of carbon may be carried out, if necessary. At the end of the first stage the temperature of the molten pig iron should be within the range from about 1500° C. and about 1700° C. When a dephosphorization flux is added to the molten pig iron at a temperature within this range, the temperature of the molten pig iron more or less decreases depending upon the amount of the added flux. Nevertheless, the high temperature (about 1500°–1700° C.) of the molten pig iron at the end of the first stage ensures a high temperature required for effective slag dephosphorization in the second stage.

In the second stage of the process, a dephosphorizing flux is added to the molten pig iron which has been treated in the first stage; after or during the addition of the dephosphorizing flux the content in the vessel is agitated by bottom blowing thereinto a non-oxidizing gas to promote effective contact of the molten pig iron with a slag formed; and the slag is removed from the vessel. The flux may be added from the top of the vessel, or from the bottom of the vessel by carrying it with the bottom blown gas. While the necessary amount of the flux may be added at once, portionwise or continuous addition is preferred. The stronger the agitation caused by the bottom blown gas, the better the dephorization proceeds. Preferably, the bottom blown non-oxidizing gas is blown at a flow rate of at least 10 $Nm^3$/hr. ton. As materials for the flux use is made of fluorite, industry grade lithium carbonate, mill scale and lime. It is preferred to use materials containing the smallest possible amounts of $SiO_2$, $Al_2O_3$ and MgO so as to avoid undesirable contamination of the slag formed therefrom. To achieve appreciable dephosphorization at least 30 Kg of the flux will be required per ton of the molten pig iron. However, use of the flux in excess of about 80 Kg/ton pig iron should normally be avoided or otherwise intolerable heat absorption is caused. In the course of the dephosphorization treatment, C in the molten pig iron actively reduces iron oxides in the slag due to the strong agitation, and thus the concentration of iron oxides in the slag rapidly decreases. If this concentration of iron oxides in the slag decreases to a level of below about 1.0%, rephosphorization occurs. Accordingly, the dephosphorization treatment should preferably be stopped before the concentration of iron oxides in the slag decreases to a level of about 1.0% or below.

If the bottom blowing of a non-oxidizing gas for agitating the chromium-containing molten pig iron with the added dephosphorizing flux is stopped within a relatively short period of time to avoid the above-mentioned rephosphorization problem due to the decrease of the iron oxides concentration in the slag, a desirably low P content is not necessarily achieved. One approach for maintaining the iron oxides concentration in the slag for a relatively long dephosphorization time will be to use a flux having an increased concentration of iron oxides. However, an increase of iron oxides in the flux acts to adversely affect the fluidity of the slag, and thus use of a flux having an iron oxides concentration in excess of 50% by weight must be avoided. Another approach will be to supply an additional source of iron oxides, such as mill scale to the molten pig iron being blown. A still further approach will be to top blow oxygen onto the material being treated in the vessel in at least the last part of the dephosphorization step i.e. step F thereby to maintain the concentration of iron oxides in the slag not less than 1.0% by weight. We prefer the second and third approaches. A second stage involving the oxygen top blowing will be referred to herein as an improved second stage. In the improved second stage oxygen, as an auxiliary oxidizing agent, can be effectively supplied to the slag, compensating shortage of oxygen to be supplied by the iron oxides for dephosphorization. Thus, without suffering from the problem of rephosphorization due to shortage of oxygen to be supplied by the iron oxides in the slag, the dephosphorization treatment may be carried out to a desirably low P level.

If a desired low P level is not obtained at the end of the second stage or improved second stage, such a stage may be repeated or cycled until the desired low P level is achieved, with an intermediate step, between the two successive cycles, of raising the temperature of the molten pig iron by bottom and/or top blowing oxygen with or without addition of a carbon source, silicon source or other similar oxidizable exothermic material to the molten pig iron. When the second stage or improved second stage is repeated, a temperature loss of the molten pig iron is unavoidable. However, such a loss of temperature can be conveniently and readily compensated by urilizing the known characteristic feature of the vessel employed. For raising the temperature of the molten pig iron by oxygen blowing, C and Si in the molten pig iron may be utilized. If necessary externally added materials may also be utilized for this purpose, including, for example, a carbon source such as those usable in the first stage, a silicon source such as FeSi, and Al. When heat of oxidation of materials other than C is utilized, a basicity adjusting agent such as CaO need be added. In any event, this temperature raising step is carried out so as to provide a chromium-containing molten pig iron having a temperature within the range between about 1500° C. and about 1700° C., and containing at least 4.5% by weight of C and not more than 0.15% by weight of Si. After the blowing, any slag formed may be removed, if necessary. One of the advantages of the process of the invention resides in the fact that the second stage can be repeated, enabling to dephosphorize the chromium-containing molten pig iron to a desirably low P level without substantially suffering from an oxidation loss of chromium.

When the first and second stages are completed, there is obtained in the vessel a low P, low Si and high C chromium-containing molten pig iron, which may be further processed in the same vessel by a so-called AOD process to prepare a low P stainless steel i.e., it may be subjected to a rough decarburization refining in the same vessel (by oxygen top or bottom blowing) and further to a reductive finish decarburization in the same vessel with bottom blowing of an inert gas or a mixture of an inert gas and oxygen. It should be appreciated, however, that the above-mentioned low P, low Si and high C chromium-containing pig iron from the dephosphorization stage or low P, low Si and low C chromium-containing pig iron from the rough decarbonization in the same vessel may also be decarburized by a known process, such as VOD and RH.OB processes, in other vessels.

By the process according to the invention an additional effect that desulfurization also proceeds is obtained. In addition, a reduced content of N in the steel is also achieved by the process of the invention.

EXAMPLE 1

An AOD vessel having at the bottom three tuyeres adapted to blowing of oxygen and a non-oxidizing gases and also equipped with a lance adapted to top blowing of oxygen was charged with 30 ton of a chromium-containing molten pig iron having a composition indicated in Table 1 (indicated in Table 1 as "1st stage, before treatment"). To the molten pig iron, 1.2 ton of particulate coke and 1 ton of lime were added, and the first stage treatment was carried out by bottom blowing 500 $Nm^3$/hr of argon and 1500 $Nm^3$/hr of oxygen from the tuyeres and top blowing 600 $Nm^3$/hr of oxygen for 20 minutes. The composition and temperature of the molten pig iron at the end of the first stage is shown in Table 1.

To the molten pig iron so treated 150 Kg of lithium carbonate, 300 Kg of lime, 900 Kg of fluorite and 750 Kg of mill scale were added, and the second stage treatment was carried out by bottom blowing 700 $Nm^3$/hr of argon through the tuyeres for 8 minutes. The composition and temperature of the molten pig iron at the end of the second stage is shown in Table 1.

The so-treated molten pig iron was subjected to decarburization, reductive refining and component adjustment in accordance with a conventional AOD process whereby a low P stainless steel having a composition indicated in Table 1 (as "3rd stage, after treatment") was obtained.

TABLE 1

| | | Metal components (% by weight) | | | | | |
|---|---|---|---|---|---|---|---|
| | | C | Si | P | Ni | Cr | Temp. |
| 1st stage | Before | 3.63 | 1.47 | 0.020 | 8.90 | 18.45 | 1450° C. |
| | After | 5.32 | 0.03 | 0.021 | 8.81 | 18.37 | 1600° C. |
| 2nd stage | Before | — | — | — | — | — | — |
| | After | 5.14 | 0.02 | 0.009 | 8.85 | 18.16 | 1450° C. |
| 3rd stage | Before | — | — | — | — | — | — |
| | After | 0.061 | 0.57 | 0.011 | 8.40 | 18.32 | — |

EXAMPLE 2

An AOD vessel having at the bottom three tuyeres adapted to blowing of oxygen and a non-oxidizing gases and also equipped with a lance adapted to top blowing of oxygen was charged with 30 ton of a chromium-containing molton pig iron having a composition indicated in Table 2 (indicated in Table 2 as "1st stage, before treatment"). To the molten pig iron, 1.2 ton of particulate coke and 1 ton of lime were added, and the first stage treatment was carried out by bottom blowing 500 $Nm^3$/hr of argon and 1500 $Nm^2$/hr of oxygen from the tuyeres for 20 minutes. The composition and temperature of the molten pig iron at the end of the first stage is shown in Table 2.

To the molten pig iron so treated 150 Kg of lithium carbonate, 300 Kg of lime, 900 Kg of fluorite and 500 Kg of of mill scale were added, and the second stage treatment was carried out by bottom blowing 700 $Nm^3$/hr of argon through the tuyeres and top blowing 600 $Nm^3$/hr of oxygen through the lance for 8 minutes. The composition and temperature of the molten pig iron at the end of the second stage is shown in Table 2.

The so-treated molten pig iron was subjected to decarburization, reductive refining and component adjustment in accordance with a conventional AOD process whereby a low P stainless steel having a composition indicated in Table 2 (as "3rd stage, after treatment") was obtained.

TABLE 2

| | | Metal components (% by weight) | | | | | |
|---|---|---|---|---|---|---|---|
| | | C | Si | P | Ni | Cr | Temp. |
| 1st stage | Before | 3.41 | 1.53 | 0.022 | 8.93 | 18.33 | 1450° C. |
| | After | 5.40 | 0.06 | 0.022 | 8.82 | 18.25 | 1600° C. |
| 2nd stage | Before | — | — | — | — | — | — |
| | After | 5.17 | 0.02 | 0.010 | 8.87 | 17.84 | 1600° C. |
| 3rd stage | Before | — | — | — | — | — | — |
| | After | 0.063 | 0.58 | 0.012 | 8.43 | 18.20 | — |

EXAMPLE 3

The precedure of Example 2 was repeated except that the second stage of Example 2 was repeated twice and that between the first cycle of the second stage and the second cycle of the second stage the temperature of the molten pig iron was raised to 1570° C. by adding 1.0 ton of lime, 0.3 ton of ferrosilicon and 0.5 ton of particulate coke to the molten pig iron, and top blowing 600 $Nm^3$/hr of argon and 1500 $Nm^3$/hr of oxygen though the tuyeres.

Results are shown in Table 3.

TABLE 3

| | | Metal components (% by weight) | | | | | |
|---|---|---|---|---|---|---|---|
| | | C | Si | P | Ni | Cr | Temp. |
| 1st stage | Before | 3.57 | 1.47 | 0.023 | 8.85 | 18.21 | 1450° C. |
| | After | 5.53 | 0.10 | 0.022 | 8.80 | 18.18 | 1600° C. |
| 2nd stage | Before | — | — | — | — | — | — |
| | After | 5.45 | 0.03 | 0.011 | 8.79 | 18.01 | 1450° C. |
| Raising | Before | — | — | — | — | — | 1450° C. |
| temp. | After | 5.30 | 0.07 | 0.012 | 8.75 | 18.06 | 1570° C. |
| 2nd stage | Before | — | — | — | — | — | — |
| | After | 5.20 | 0.02 | 0.006 | 8.79 | 17.83 | 1450° C. |
| 3rd stage | Before | — | — | — | — | — | — |
| | After | 0.066 | 0.53 | 0.008 | 8.54 | 18.34 | — |

EXAMPLE 4

A low P stainless (SUS 304) was prepared following the scheme as noted below:

Charge of high P material → De—Si Re—C → 1st De—P → temp. raising → 2nd De—P → temp. raising → 3rd De—p → Conventional refining → Continuous casting An AOD vessel equipped with a lance for top blowing oxygen and with three tuyeres of a concentric double tube structure for bottom blowing nitrogen and oxygen was charged with about 30 ton of a molten pig iron containing in % by weight 3.7% of C, 1.5% of Si, 0.025% of P, 0.60% of S, 9.0% of Ni and 18.0% of Cr. To the molten pig iron at a temperature of about 1450° C., 1.6 ton of particulate coke and 1.5 ton of lime were added, while bottom blowing a small amount of nitrogen. After the addition of the coke, bottom blowing of nitrogen at a rate of 17 $Nm^3$/hr ton and bottom blowing of oxygen at a rate of 50 $Nm^3$/hr ton were started, and 5 minutes thereafter top blowing of oxygen was started at a rate of 22 $Nm^2$/hr ton. After about 20 minutes from the beginning of the nitrogen and oxygen blowing, all blowings were stopped and the slag was removed. The molten pig iron in the vessel contained 5.3% of C and 0.12% of Si and had a temperature of about 1600° C.

To the molten pig iron so treated there were added 6 Kg/ton of industry grade lithium carbonate, 29 Kg/ton of fluorite and 15 Kg/ton of mill scale. The content in the vessel was processed by bottom blowing 28 $Nm^3$/hr ton of nitrogen and top blowing 22 $Nm^3$/hr ton of oxygen for 8 minutes during which 5 Kg/ton of mill scale was introduced into the vessel by carrying it with the bottom blown nitrogen. At the end of the period, blowing was stopped and the slag was removed from the vessel. The molten pig iron in the vessel contained 0.011% of P and had a temperature of about 1450° C.

The dephosphorization procedure was repeated further twice. Before each of the 2nd and 3rd dephosphorization stages, the temperature of the molten pig iron was raised to about 1600° C. by adding thereto 20 Kg/ton of lime, 20 Kg/ton of particulate coke and 7 Kg/ton of ferrosilicon, top blowing 22 $Nm^3$/hr ton of oxygen while bottom blowing 17 $Nm^3$/hr ton of nitrogen and 50 $Nm^3$/hr ton of oxygen, and removing the slag from the vessel.

The molten pig iron so treated was then refined following a conventional AOD process. The final product (SUS 304 stainless steel) contained 60 ppm of P.

In each desphosphorization stage, the attained degree of dephosphorization was within the range between about 50 and 60%, and an oxidation loss of chromium was about 0.3% by weight.

What is claimed is:

1. A process for producing a low P chromium-containing steel, in a vessel equipped with a lance adapted to top blowing of oxygen and with at least one tuyere of a double tube structure adapted to bottom blowing of oxidizing and non-oxidizing gases alone or in combination, starting from a chromium-containing molten pig iron which contains not more than 4.5% by weight of C, at least 0.010% by weight of P and at least 3.0% by weight of Cr, said process comprising the steps of:

A. adding a solid carbon source to the chromium-containing molten pig iron in the vessel in an amount sufficient to provide a chromium-containing molten pig iron of a carbon content of at least 4.5% by weight at the end of the step D below, B. agitating the content in the vessel by bottom blowing thereinto a non-oxidizing gas, C. blowing oxygen to the molten pig iron to provide a chromium-containing molten pig iron of a temperature ranging between 1500° C. and 1700° C. containing not more than 0.15% by weight of Si and at least 4.5% by weight of C, D. substantially removing a slag formed in the preceding steps from the vessel, E. adding a dephosphorization flux to the molten pig iron in the vessel, wherein said dephosphorizing flux comprises 30–80% by weight of at least one compound selected from the fluorides and chlorides of alkaline earth metals, 0.4 to 30% by weight of at least one compound selected from lithium oxide and lithium carbonate, 5–50% by weight of at least one compound selected from iron oxides and nickel oxide, and 0–40% by weight of at least one compound selected from the oxides and carbonates of alkaline earth metals, F. agitating the content in the vessel by bottom blowing thereinto a non-oxidizing gas to promote effective contact of the molten pig iron with a slag formed, while maintaining the concentration of iron oxides in the slag at a level of at least 1.0% by weight, G. substantially removing the slag from the vessel, and H. blowing oxygen to the molten pig iron in the vessel for decarburization, while bottom blowing thereinto a non-oxidizing gas.

2. The process for producing a low P chromium-containing steel in accordance with claim 1, wherein at least the last part of the step F is carried out while top blowing oxygen onto the content in the vessel thereby maintaining the concentration of iron oxides in the slag at a level of at least 1.0% by weight.

3. A process for producing a low P chromium-containing steel, in a vessel equipped with a lance adapted to top blowing of oxygen and with at least one tuyere of a double tube structure adapted to bottom blowing of oxidizing and non-oxidizing gases alone or in combination, starting from a chromium-containing molten pig iron which contains not more than 4.5% by weight of C, at least 0.010% by weight of P and at least 3.0% by weight of Cr, said process comprising the steps of:

A. adding a solid carbon source to the chromium-containing molten pig iron in the vessel in an amount sufficient to provide a chromium-containing molten pig iron of a carbon content of at least 4.5% by weight at the end of the step D below, B. agitating the content in the vessel by bottom blowing thereinto a non-oxidizing gas, C. blowing oxygen to the molten pig iron to provide a chromium-containing molten pig iron of a temperature ranging between 1500° C. and 1700° C. containing not more than 0.15% by weight of Si and at least 4.5% by weight of C, D. substantially removing a slag formed in the preceding steps from the vessel, E. adding a dephosphorization flux to the molten pig iron in the vessel, wherein said dephosphorizing flux comprises 30–80% by weight of at least one compound selected from the fluorides and chlorides of alkaline earth metals, 0.4 to 30% by weight of at least one compound selected from lithium oxide and lithium carbonate, 5–50% by weight of at least one compound selected from iron oxides and nickel oxide, and 0–40% by weight of at least one compound selected from the oxides and carbonates of alkaline earth metals, F. agitating the content in the vessel by bottom blowing thereinto a non-oxidizing gas to promote effective contact of the molten pig iron with a slag formed, while maintaining the concentration of iron oxides in the slag at a level of at least 1.0% by weight, G. substantially removing the slag from the vessel, I. repeating a cycle of the steps E, F and G until a desired level of P is reached, with an intermediate step, between the successive cycles, of raising the temperature of the molten pig iron to a temperature ranging between 1500° C. and 1700° C. by blowing oxygen, while controlling the carbon content of the molten pig iron not less than 4.5% by weight and the silicon content of the molten pig iron not more than 0.15% by weight, and H. blowing oxygen to the molten pig iron in the vessel for decarburization, while bottom blowing thereinto a non-oxidizing gas.

4. The process for producing a low P chromiun-containing steel in accordance with claim 3, wherein at least one intermediate step of raising the temperature of the molten pig iron is carried out with the molten pig iron having an oxidizable exothermic material added thereto.

5. The process for producing a low P chromium-containing steel in accordance with claim 3, wherein at least the last part of the step F is carried out while top blowing oxygen onto the content of the vessel thereby maintaining the concentration of iron oxides in the slag at a level of at least 1.0% by weight.

* * * * *

UNITED STATES PATENT AND TRADEMARK OFFICE

CERTIFICATE OF CORRECTION

PATENT NO. : 4,525,209

DATED : June 25, 1985

INVENTOR(S) : Takashi Yamauchi et al

It is certified that error appears in the above-identified patent and that said Letters Patent is hereby corrected as shown below:

In Column 7, line 22, before "argon" insert --oxygen through the lance under bottom blowing of 500 $Nm^3$/hr of--.

Signed and Sealed this

*First* Day of *October 1985*

[SEAL]

*Attest:*

*Attesting Officer*

DONALD J. QUIGG

*Commissioner of Patents and Trademarks—Designate*